US010345745B2

(12) United States Patent
Okugawa et al.

(10) Patent No.: US 10,345,745 B2
(45) Date of Patent: Jul. 9, 2019

(54) IMAGE FORMING APPARATUS AND FIXING DEVICE THAT CONTROL AN AIR BLOWING DEVICE BASED ON ONE OF A RECORDING MATERIAL SIZE AND A SIZE OF A PRINT REGION OF AN IMAGE

(71) Applicant: CANON KABUSHIKI KAISHA, Tokyo (JP)

(72) Inventors: Hirokazu Okugawa, Mishima (JP); Tohru Saito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/001,478

(22) Filed: Jun. 6, 2018

(65) Prior Publication Data

US 2018/0356753 A1 Dec. 13, 2018

(30) Foreign Application Priority Data

Jun. 7, 2017 (JP) ..... 2017-112601

(51) Int. Cl.
*G03G 15/20* (2006.01)

(52) U.S. Cl.
CPC ..... *G03G 15/2017* (2013.01); *G03G 15/205* (2013.01); *G03G 15/2042* (2013.01); *G03G 2215/2035* (2013.01)

(58) Field of Classification Search
CPC ..... G03G 15/2017; G03G 15/205; G03G 15/2042; G03G 15/2053; G03G 2215/2035
See application file for complete search history.

(56) References Cited

U.S. PATENT DOCUMENTS

| | | | | |
|---|---|---|---|---|
| 7,142,790 | B2 | 11/2006 | Takahashi | |
| 2007/0059012 | A1* | 3/2007 | Tomine | G03G 15/2017 399/69 |
| 2012/0282002 | A1* | 11/2012 | Murasaki | G03G 15/2017 399/329 |
| 2014/0321873 | A1* | 10/2014 | Kadowaki | G03G 15/2017 399/69 |
| 2018/0157003 | A1* | 6/2018 | Tsuchihashi | G03G 15/2017 |

FOREIGN PATENT DOCUMENTS

| | | | |
|---|---|---|---|
| JP | H04-51179 | A | 2/1992 |
| JP | 2003-076209 | A | 3/2003 |
| JP | 2005-022870 | A | 1/2005 |

* cited by examiner

*Primary Examiner* — Sophia S Chen
(74) *Attorney, Agent, or Firm* — Venable LLP

(57) ABSTRACT

An image forming apparatus includes an image forming portion, a first fixing member, and a second fixing member that forms a nip with the first fixing member. An air blowing device blows air for cooling an end portion region of at least one of the first and second fixing members with respect to a longitudinal direction, perpendicular to a recording material feeding direction, in the nip. In addition, a controller capable of selecting one of an operation in a first mode, in which cooling of the end portion region by the air blowing device is carried out depending on a recording material size, with respect to a widthwise direction of the recording material, and an operation in a second mode, in which the cooling is carried out depending on a size of a print region of the image, with respect to a direction perpendicular to the recording material feeding direction.

18 Claims, 6 Drawing Sheets

(a)

(b)

IMAGE FORMING APPARATUS AND FIXING DEVICE THAT CONTROL AN AIR BLOWING DEVICE BASED ON ONE OF A RECORDING MATERIAL SIZE AND A SIZE OF A PRINT REGION OF AN IMAGE

This application claims the benefit of Japanese Patent Application No. 2017-112601, filed Jun. 7, 2017, which is incorporated by reference herein in its entirety.

FIELD OF THE INVENTION AND RELATED ART

The present invention relates to an image forming apparatus, such as a copying machine, a laser printer, or a facsimile machine, including a fixing device for heat-fixing an unfixed toner image, formed on a recording material, to the recording material, and relates to the fixing device for use with the image forming apparatus.

As the fixing device used in the image forming apparatus, such as the printer or the copying machine of an electrophotographic type, in recent years, a fixing device of a film heating type, in which a thermal capacity of the fixing member is decreased from the viewpoints of a quick start property and energy saving, has been put into practical use. In such a fixing device of the film heating type, in order to suppress non-sheet-passing portion temperature rise in a case in which small size-paper (sheet) having a narrow width is passed through the fixing device, an image forming apparatus including air blowing means, for blowing air to a non-sheet-passing portion of the paper and for cooling the non-sheet-passing portion, has been known (Japanese Laid-Open Patent Application No. Hei 4-51179). Further, an image forming apparatus including a control means for controlling an opening area of an air blowing means, for blowing air to a non-sheet-passing portion on the basis of a width of a sheet-passing size of a recording material, has been known (Japanese Laid-Open Patent Application No. 2003-76209).

Further, an image forming apparatus capable of designating, as a paper (sheet) size (recording material size) of the recording material with respect to a widthwise direction, sizes other than regular sizes, such as A3, A4, B4, B5, and the like, has been known (Japanese Laid-Open Patent Application No. 2005-22870). In Japanese Laid-Open Patent Application No. 2005-22870, in a case in which the sheet (paper) is fed from a cassette provided with no sheet (paper) size detecting means, or in a case in which the sheet is fed from a manual feeding portion, on the assumption that a sheet having a maximum sheet-passing size is passed through the fixing device, various pieces of control are carried out.

In the conventional examples described above, however, the following problem arose. That is, in a case in which a recording material size of the recording material with respect to a recording material feeding direction is not recognized, the air blowing means is controlled on the assumption that the maximum-size sheet (paper) is passed through the fixing device, and, therefore, the sheet passing is carried out in a state in which longitudinal end portion openings, through which air is passed, are closed. On the other hand, on the assumption that the maximum-size sheet is passed through the fixing device, the fixing device carries out heat generation control so that fixing is effected to widthwise ends of the maximum-size sheet. For this reason, in a case in which a width of an actually passed sheet is less than a width of the maximum-size sheet, a non-sheet-passing portion temperature rise occurs.

SUMMARY OF THE INVENTION

A principal object of the present invention is to provide an image forming apparatus and a fixing device that are capable of properly performing cooling of an end portion region of a fixing member by an air blowing means even in a case in which a recording material size of a recording material with respect to a recording material feeding direction is not recognized.

According to one aspect, the present invention provides an image forming apparatus comprising an image forming portion configured to form an image on a recording material, first and second fixing members configured to form a nip in which the recording material, carrying the image thereon, is nipped and fed, air blowing means configured to blow air for cooling an end portion region of at least one of the first and second fixing members with respect to a longitudinal direction perpendicular to a recording material feeding direction in the nip, and a controller capable of selecting an operation in a first mode, in which cooling of the end portion region by the air blowing means is carried out depending on a recording material size with respect to a widthwise direction of the recording material, and an operation in a second mode, in which the cooling is carried out depending on an image size with respect to a direction perpendicular to the recording material feeding direction.

According to another aspect, the present invention provides a fixing device comprising first and second fixing members configured to form a nip in which a recording material, carrying an image thereon, is nipped and fed, air blowing means configured to blow air for cooling an end portion region of at least one of the first and second fixing members with respect to a longitudinal direction perpendicular to a recording material feeding direction in the nip, and a controller capable of selecting an operation in a first mode, in which cooling of the end portion region by the air blowing means is carried out depending on a recording material size with respect to a widthwise direction of the recording material, and an operation in a second mode, in which the cooling is carried out depending on an image size with respect to a direction perpendicular to the recording material feeding direction.

Further features of the present invention will become apparent from the following description of exemplary embodiments with reference to the attached drawings.

Figure 4:
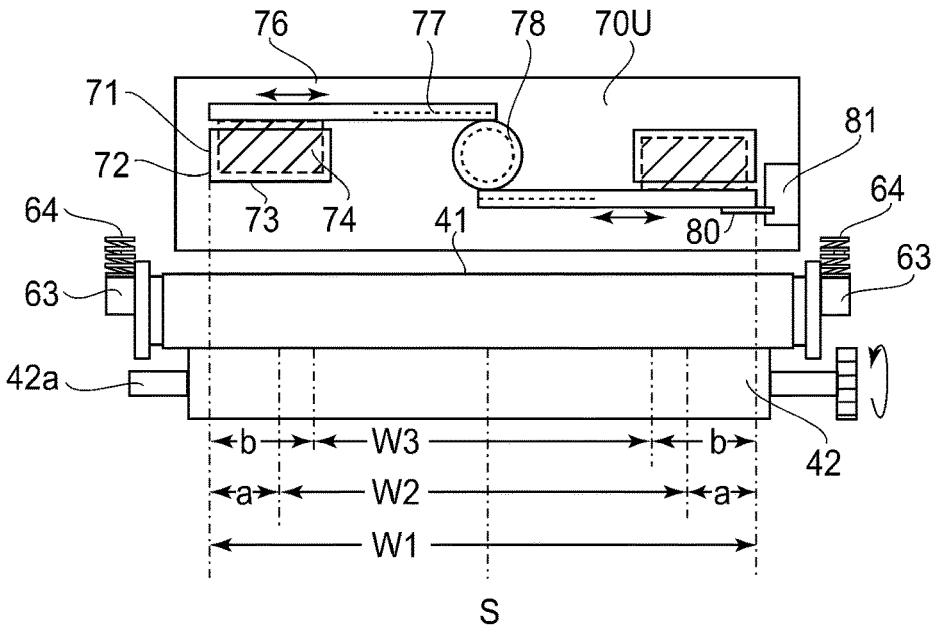
Figure 4:
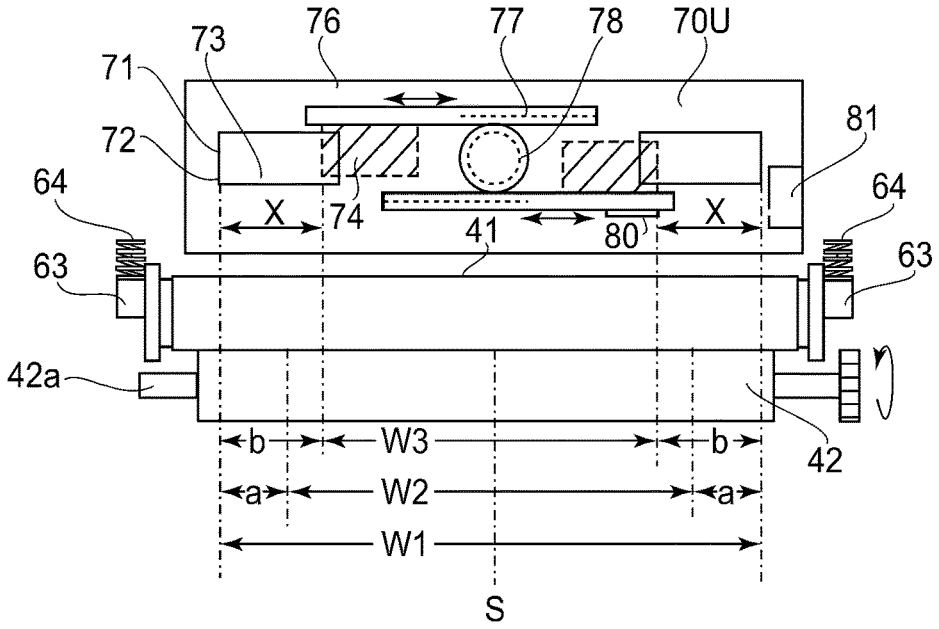

Part (a) of FIG. 4 is a schematic view of a state in which an opening of a shutter in an air blowing means in the First Embodiment is moved to a full-close position, and part (b) of FIG. 4 is a schematic view of a state in which the opening of the shutter is an open position so as to expose an end portion region corresponding to a non-sheet-passing portion.

Figure 5:
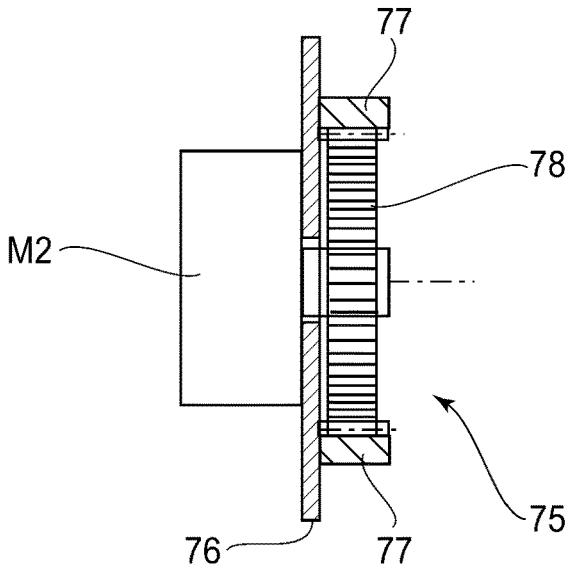

FIG. 5 is a schematic view of a driving device for moving the opening of the shutter in the air blowing means in the First Embodiment.

Figure 6:
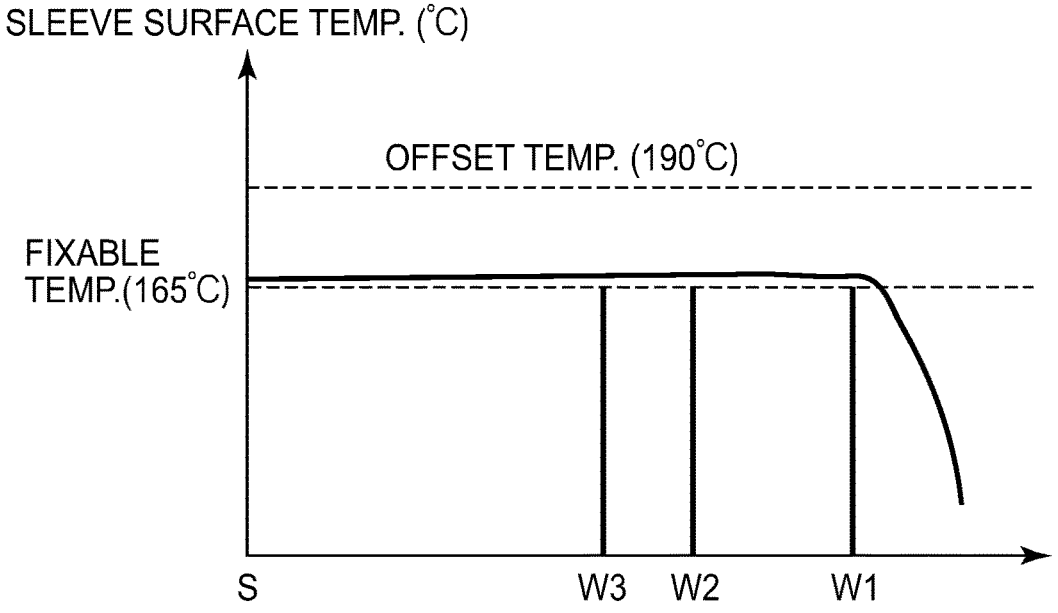

FIG. 6 is a graph showing a correlation between a high-temperature offset and a fixing sleeve surface temperature when a maximum-size sheet (paper) is continuously passed through the fixing device in a case in which a universal size is designated in the First Embodiment.

Figure 7:
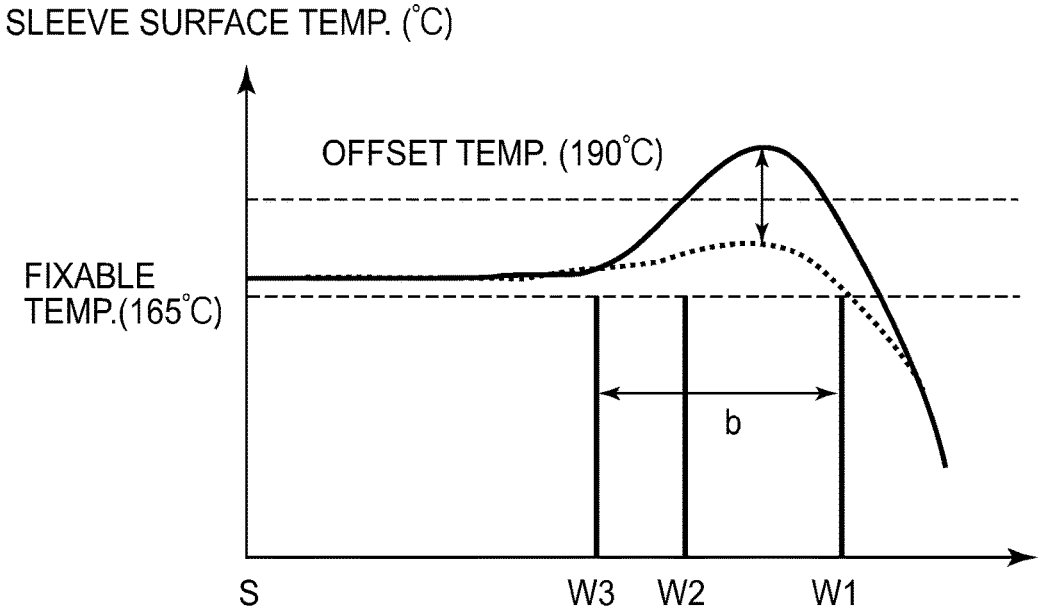

FIG. 7 is a graph showing a correlation between a high-temperature offset and a fixing sleeve surface temperature when a minimum-size sheet (paper) is continuously passed through the fixing device in a case in which the universal size is designated in the First Embodiment.

Figure 8:
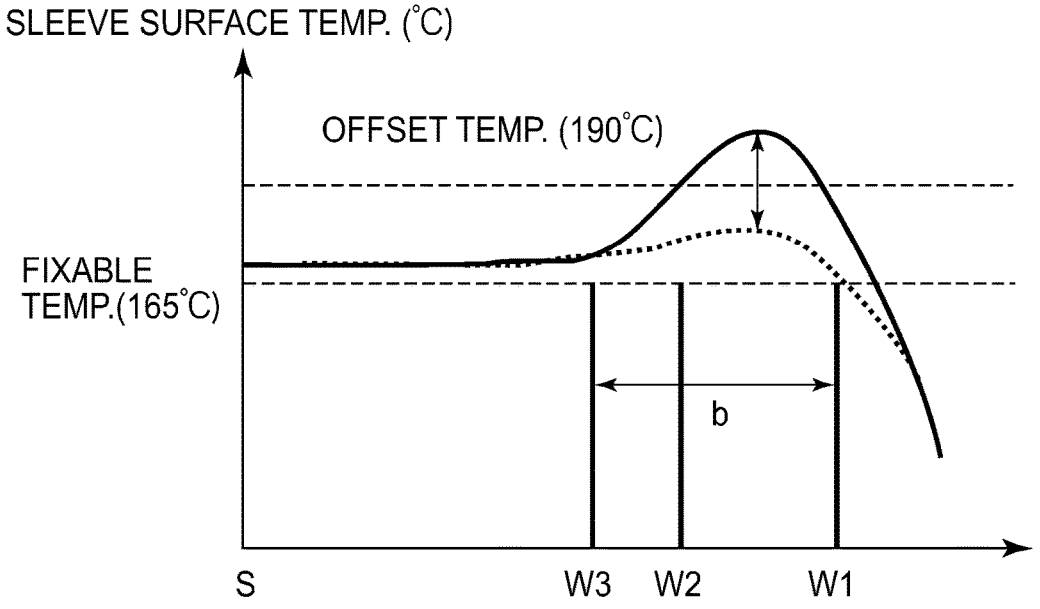

FIG. 8 is a graph showing a correlation between a high-temperature offset and a fixing sleeve surface temperature when a small size sheet (paper) is continuously passed through the fixing device in a case in which the universal size is designated in the First Embodiment.

Figure 9:
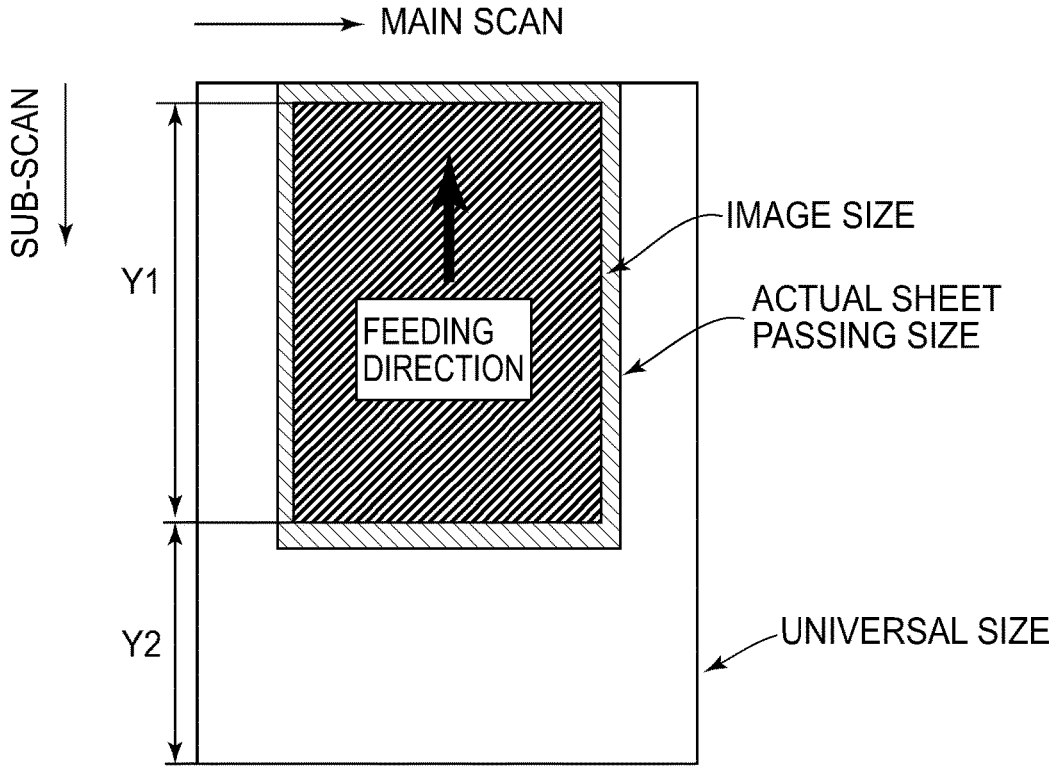

FIG. 9 is a schematic view for illustrating a relationship among the universal size, an image size, and the like.

DESCRIPTION OF EMBODIMENTS

In the following description, embodiments of the present invention will be specifically described with reference to the drawings.

First Embodiment

Image Forming Apparatus

An example of a general structure of an image forming apparatus in which a fixing device, according to an embodiment of the present invention, is mounted will be described together with an image forming operation with reference to FIG. 1. The image forming apparatus in this embodiment is a color laser (beam) printer that uses an intermediary transfer electrophotographic process and that is 135 mm/s in process speed and 30 pages per minute (ppm) (A4-size short edge feeding) in throughput.

The color laser printer includes toner cartridges 1*a*, 1*b*, 1*c*, and 1*d* detachably mountable to an image forming apparatus main assembly. These four toner cartridges 1*a*, 1*b*, 1*c*, and 1*d* have the same structure but are different in that images are formed with toners of different colors of yellow (Y), magenta (M), cyan (C), and black (K), respectively.

The toner cartridges 1*a*, 1*b*, 1*c*, and 1*d* are constituted by developing units 7*a*, 7*b*, 7*c*, and 7*d* and image bearing member units 8*a*, 8*b*, 8*c*, and 8*d*.

The developing units 7*a*, 7*b*, 7*c*, and 7*d* include developing rollers 4*a*, 4*b*, 4*c*, and 4*d*. The image bearing member units 8*a*, 8*b*, 8*c*, and 8*d* include photosensitive drums 2*a*, 2*b*, 2*c*, and 2*d* as image bearing members, charging rollers 3*a*, 3*b*, 3*c*, and 3*d*, drum cleaning blades 5*a*, 5*b*, 5*c*, and 5*d*, and a residual toner container (not shown).

Below the toner cartridges 1*a*, 1*b*, 1*c*, and 1*d*, a scanner unit 6 is provided and exposes the photosensitive drums 2*a*, 2*b*, 2*c*, and 2*d* to light on the basis of an image signal. A direction perpendicular to a rotational direction of the photosensitive drums is a scanning direction (main scan direction). In this case, the photosensitive drums 2*a*, 2*b*, 2*c*, and 2*d* are electrically charged by the charging rollers 3*a*, 3*b*, 3*c*, and 3*d* to a predetermined negative potential, and, thereafter, electrostatic latent images are formed thereon.

The electrostatic latent images are reversely developed by the developing units 7*a*, 7*b*, 7*c*, and 7*d*, so that negatively charged toners are deposited thereon and thus, toner images of yellow, magenta, cyan, and black are formed, respectively.

In an intermediary transfer belt unit 30, an intermediary transfer belt 31 is stretched around a driving roller 32, a secondary transfer opposite roller 36, and a tension roller 33, and a tension is exerted on the tension roller 33 in an arrow B direction. Further, inside the intermediary transfer belt 31, primary transfer rollers 34*a*, 34*b*, 34*c*, and 34*d* are provided opposed to the photosensitive drums 2*a*, 2*b*, 2*c*, and 2*d*, and a transfer bias is applied thereto by an unshown bias applying means.

The toner images formed on the photosensitive drums 2*a*, 2*b*, 2*c*, and 2*d* are successively primary-transferred onto the intermediary transfer belt 31 by rotation of the respective photosensitive drums in arrow directions and rotation of the intermediary transfer belt 31 in an arrow A direction. Specifically, by applying a positive bias to the primary transfer rollers 34*a*, 34*b*, 34*c*, and 34*d*, the toner images are successively primary-transferred onto the intermediary transfer belt 31 from the toner image on the photosensitive drums 2*a*, 2*b*, 2*c*, and 2*d*, so that the toner images of the four colors are fed to a secondary transfer nip 37 in a state in which the four color toner images are superposed.

A sheet feeding (conveying) device 20 includes a sheet (paper) feeding roller 22 for feeding a recording material P from a sheet feeding cassette 21 accommodating the recording material (recording paper) P, and includes a conveying roller 24 for conveying the recording material P fed from the sheet feeding cassette 21. Then, the recording material P conveyed from the sheet feeding device 20 is conveyed in a direction substantially perpendicular to the secondary transfer nip 37 by a registration roller pair 23. Then, in the secondary transfer nip 37, a positive bias is applied to a secondary transfer roller 35, so that the toner images of the four colors are secondary-transferred from the intermediary transfer belt 31 onto the conveyed recording material P.

The recording material P, after the toner image transfer, is conveyed to a fixing device 40 and is heated and pressed by a fixing sleeve 41, as a rotatable heating member (first fixing member), and a pressing roller 42, as a second fixing member, which form a nip in cooperation with each other, so that the toner images are fixed on the surface of the recording material P. The recording material P, on which the toner images are fixed, is discharged on a discharge tray 44 by a sheet discharging roller pair 43.

The toners remaining on the photosensitive drums 2*a*, 2*b*, 2*c*, and 2*d* after the toner image transfer (primary transfer) are removed by cleaning blades 5*a*, 5*b*, 5*c*, and 5*d*, respectively. Further, the toner remaining on the intermediary transfer belt 31 after the secondary transfer onto the recording material P is removed by a cleaning blade 51 of a transfer belt cleaning device 50, and the removed toner is passed through a residual toner feeding path 52 and is collected in the unshown residual toner container.

Figure 1:
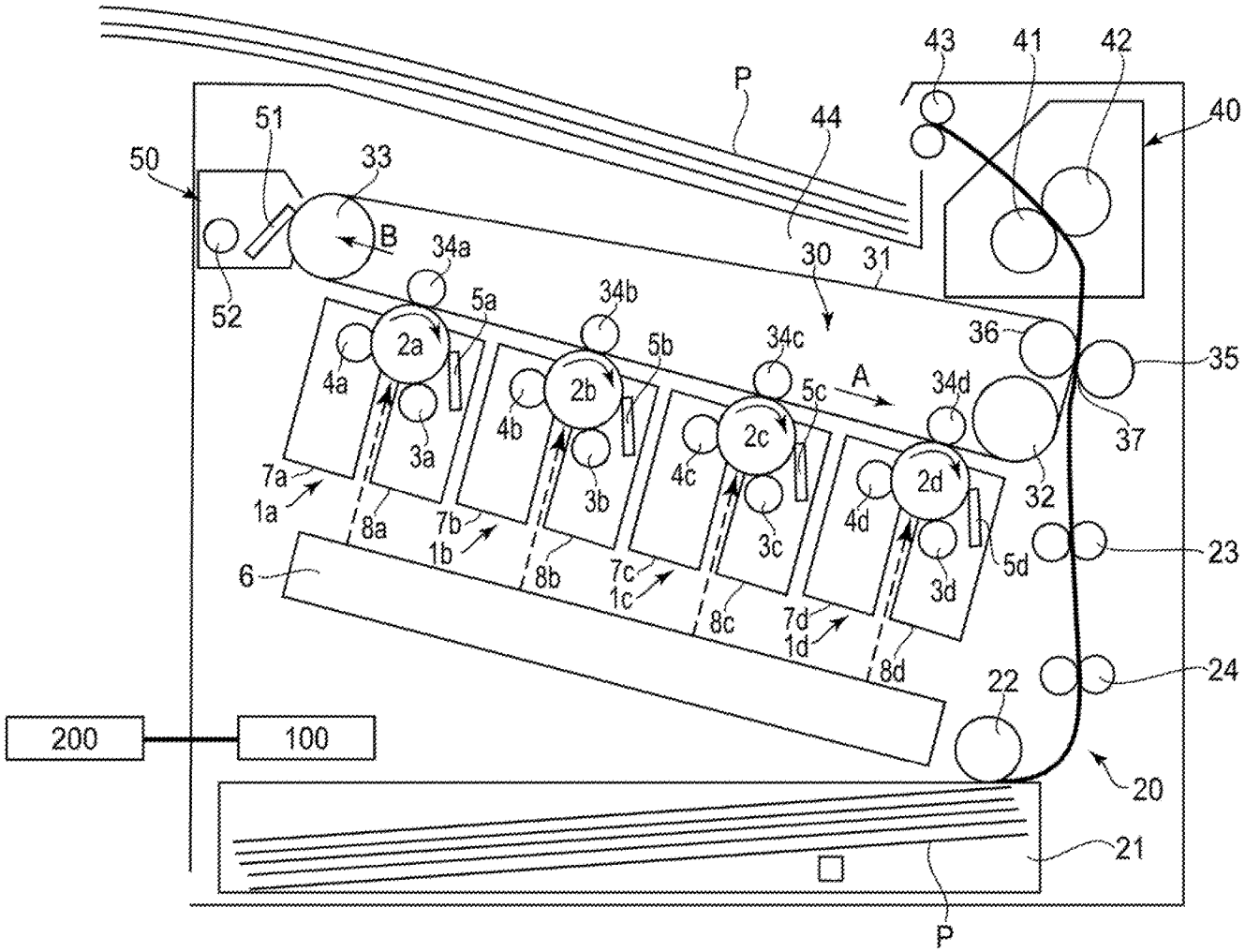
FIG. 1 is a schematic view showing a general structure of an image forming apparatus in which a fixing device, according to the present invention, is mounted.

In FIG. 1, the image forming apparatus includes a controller 100 and a controller portion 200, which are described specifically later.

Herein, a longitudinal direction of the fixing member, described later, is a direction perpendicular to a recording material feeding direction and a recording material thickness direction, and a widthwise direction of the recording material is a direction parallel to the longitudinal direction of the fixing member.

As regards control of the controller 100 in the image forming apparatus, the controller 100 is capable of selecting an operation in a first mode, which is carried out depending on a recording material size with respect to the widthwise direction of the recording material (hereafter, the recording material size is referred to as a sheet (paper) size) or an operation in a second mode (universal mode), which is carried out depending on an image size with respect to the widthwise direction of the recording material. Specifically, the operation in the second mode (universal mode) is selectable by a user in a case in which the sheet is fed from a cassette provided with no sheet size detecting means or from a manual feeding portion.

Hereafter, the sheet (paper) size when the second mode is selected by the user is referred to as a universal size. The universal size includes the case of irregular sizes different from A3, A4, B4, B5, and like sizes, and the case of regular sizes, such as A3, A4, B4, and B5 sizes.

Fixing Device

Figure 2:
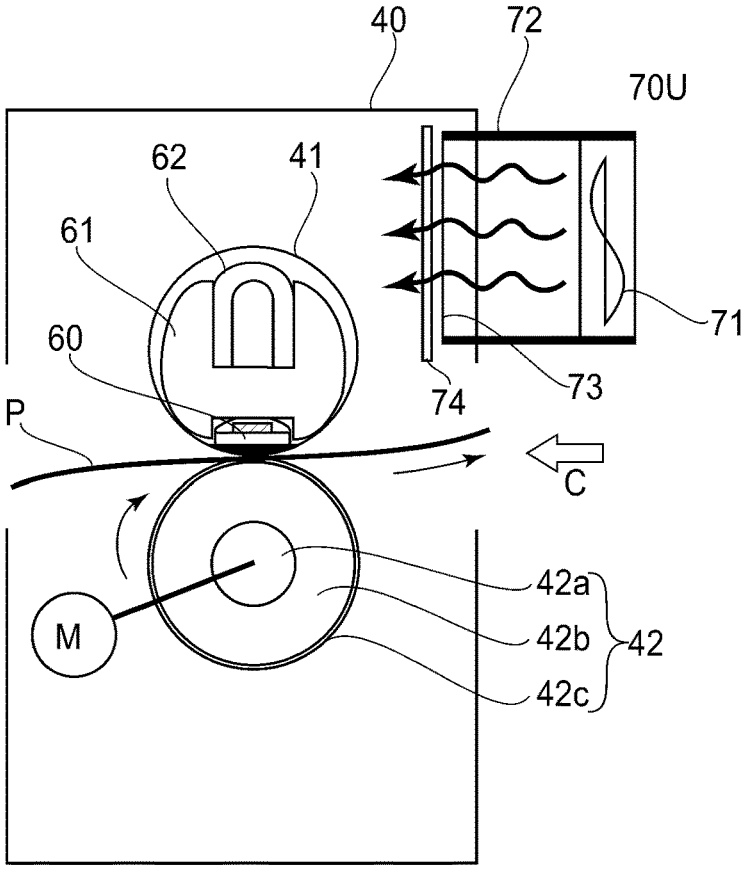
FIG. 2 is a schematic cross-sectional view of a fixing device according to a First Embodiment.
Figure 3:
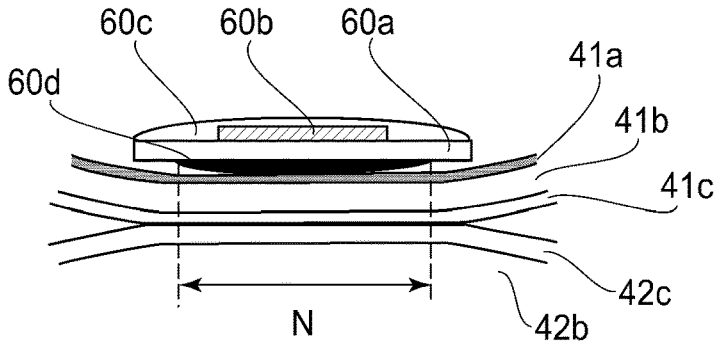
FIG. 3 is a schematic sectional view of a neighborhood of a nip of the fixing device in the First Embodiment.

FIG. 2 is a schematic cross-sectional view of the fixing device 40 according to this embodiment, and FIG. 3 is an enlarged schematic sectional view of a neighborhood of a fixing nip with respect to the recording material feeding direction. Here, the fixing nip is a heated region in which the recording material is to be nipped by the opposing first and second fixing members, and in which the recording material, on which the image formed by the image forming portion is carried, is subjected to heat-fixing of the image while being nipped and conveyed.

Parts (a) and (b) of FIG. 4 are schematic views of a rotatable heating member as the fixing member with respect to a rotational axis direction (longitudinal direction) as seen from a downstream (from an arrow C direction in FIG. 2) side of the fixing device 40 with respect to the feeding direction of the recording material P. As regards a cooling fan (blower) 71 and a shutter 74, as a control means for controlling an opening width of the cooling fan, these will be described later as an air blowing means (air blowing cooling means) for performing air blowing cooling in this embodiment.

Referring to FIG. 2, the fixing device 40 includes the fixing sleeve (first fixing member) 41 as a flexible belt member, the pressing roller (second fixing member) 42 as a pressing member, and a heater 60 as a heat generating member, and the pressing roller 42 is pressed toward the heater 60. Further, between the heater 60 and the fixing sleeve 41, an unshown fixing grease is interposed, so that a frictional force is reduced and thus, the fixing sleeve 41 is smoothly rotated by the pressing roller 42.

Such a fixing device 40 heats the image by nip-conveying the recording material P, carrying thereon the image, through the nip N formed between the fixing sleeve 41 and the pressing roller 42. The recording material P passed through the fixing nip N is separated from the surface of the fixing sleeve 41 and is discharged and conveyed.

In this embodiment, the feeding (conveyance) of the recording material P is carried out by so-called center (line)-basis feeding (conveyance), with the recording material P disposed at a central portion. That is, even as regards the recording materials having any width passable to the fixing device 40, a widthwise center position of the recording material P passes through a longitudinal center position of the fixing sleeve 41. A line S, shown in parts (a) and (b) of FIG. 4, is a recording material passing reference center line (phantom line) in the center-basis feeding.

In parts (a) and (b) of FIG. 4, W1 represents a sheet-passing width (maximum sheet-passing width) of a maximum width recording material P passable through the fixing device 40. In this embodiment, the maximum sheet-passing width W1 is a width of 297 mm (A3 size, width: 297 mm×length: 420 mm) in A3 short edge feeding. An effective heat generation region width of the heater 60 with respect to the longitudinal direction is 312 mm, which is greater than the maximum sheet-passing width W1 (297 mm).

In parts (a) and (b) of FIG. 4, W3 represents a sheet-passing width (minimum sheet-passing width) of a minimum width recording material P passable through the fixing device 40. In this embodiment, the minimum sheet-passing width W3 is a width 210 mm (A4 size, width: 210 mm×length: 297 mm) in A4 short edge feeding. Further, W2 represents a sheet-passing width of a recording material having a width between those of the maximum width recording material and the minimum width recording material. In this embodiment, as the sheet-passing width W2, a size width of 257 mm (B4 size, width: 257 mm×length: 364 mm) in B4 short edge feeding is shown as an example in parts (a) and (b) of FIG. 4.

Hereafter, a recording material P having a width corresponding to the maximum sheet-passing width W1 is referred to as a maximum size recording material, and a recording material P having a width less than the width (maximum sheet-passing width W1) is referred to as a small size recording material. In parts (a) and (b) of FIG. 4, "a" is a difference width portion between the maximum sheet-passing width W1 and the sheet-passing width W2 (i.e., (W1−W2)/2), and "b" is a difference width portion between the maximum sheet-passing width W1 and the minimum sheet-passing width W3 (i.e., (W1−W3)/2), and each of these difference width portions a and b is a non-sheet-passing portion that is generated when the recording material P, which is the small size recording material (in B4 or A4 short edge feeding) is fed through the nip N. In this embodiment, the sheet-passing of the recording material P is carried out on the center-basis, and, therefore, the non-sheet-passing portion a generates on left and right side portions outside the sheet-passing width W2, and the non-sheet-passing portion b generates on left and right side portions outside the minimum sheet-passing width W3. Widths of these non-sheet-passing portions a and b varies depending on values of the width of the small size recording material subjected to sheet-passing.

Fixing Sleeve

The fixing sleeve 41, as a hollow rotatable heating member, is prepared by forming an elastic layer 41*b* on an outer peripheral surface of a base layer 41*a* (FIG. 3) formed in a cylindrical shape, and then forming a parting layer 42*c* on an outer peripheral surface of the elastic layer 42*b*. This fixing sleeve 41 has a cylindrical shape having an inner diameter of 24 mm. In the base layer 41*a*, a resin-based material, such as polyimide, or a metallic material, such as stainless steel (SUS) is used. In this embodiment, in view of a balance with strength, a SUS sleeve was used as a metal base layer formed in a thickness of 30 μm and in an endless shape.

In the elastic layer 41, from the viewpoint of a quick start, a material having high thermal conductivity may desirably be used to the extent possible. Therefore, in this embodiment, as the elastic layer 41*b*, a silicone rubber layer of about 250 μm in thickness, and $1.0\times10^{-3}$ cal/sec·cm·K in thermal conductivity, was used.

The parting layer 41*c* is provided for preventing an offset phenomenon that occurs by deposition of the toner once on the surface of the fixing sleeve 41 and then movement of the toner to the recording material P. As a material of the parting layer 41*c*, a fluorine-containing resin material, such as polytetrafluoroethylene (PTFE) or perfluoroalkoxy alkane (PFA), is used. In this embodiment, the parting layer 41*c* is formed PFA tube having a thickness of about 20 μm, and is coated on an outer peripheral surface of the silicone rubber layer as the elastic layer 41*b*. In this embodiment, a longitudinal dimension of the fixing sleeve 41 has a margin with respect to the maximum sheet-passing width and is about 340 mm.

Pressing Roller

In FIG. 2, the pressing roller 42 as the pressing member is prepared by forming an electroconductive silicone rubber layer having a thickness of about 3 mm, as an elastic layer 42*b* on an outer peripheral surface of a metal core 42*a* having a cylindrical shaft shape, and then coating an PFA tube having a thickness of about 50 μm, as a parting layer 42*c*, on an outer peripheral surface of the elastic (rubber) layer 42*b*. This pressing roller 42 is held (supported) by frames of the fixing device 40 via unshown bearings at longitudinal end portions of the metal core 42*a*, so as to oppose the heater 60, and parallel to the heater 60 along the longitudinal direction. A roller portion consisting of the elastic layer 42*b* and the parting layer 42*c* of the pressing roller 42 is 25 mm in outer diameter and 325 mm in length (width) with respect to the longitudinal direction.

The pressing roller 42 is rotationally driven by a driving means M in an arrow direction at a peripheral speed of 135 mm/sec. The fixing sleeve 41 is rotated around a heater holder 61 at the same speed as the rotational speed of the pressing roller 42 by a frictional force with the pressing roller 42.

Heater

The heater 60, as a heat generating member (heating source) for heating the nip N, includes an elongated thin substrate 60*a* (FIG. 3) extending in the longitudinal direction (direction perpendicular to the recording material feeding direction). This substrate 60*a* is an insulating substrate that is formed of ceramic, such as alumina or aluminum nitride, and has good thermal conductivity. In this embodiment, as the substrate 60*a*, an alumina substrate formed in a rectangular shape so as to have a thickness of 1 mm, a width of 8 mm, and a longitudinal size of 375 mm, was used, in view of a balance between thermal capacity and strength.

On a back surface of the substrate 60*a*, a heat generation resister layer 60*b*, as a heat generating element, is formed along the longitudinal direction of the substrate 60*a*. A heat generating resistor layer 60*b* is formed of a silver-palladium (Ag—Pd) alloy, a nickel-tin (Ni—Sn), a Ruthenium ($RuO_2$) alloy, or the like, as a main component and is molded in a shape of about 10 μm in thickness, 312 mm in length, and 4 mm in width. The heat generating resistor layer 60*b* generates heat by energization from a longitudinal end portion by an unshown power source.

An insulating glass layer 60*c* overcoats the heat generating resistor layer 60*b*, and not only ensures an insulating property from an external electroconductive member but also has an anti-corrosion function of preventing the heat generating resistor layer 60*b* from changing in resistance value due to oxidation, or the like, and has a function of preventing mechanical damage. Incidentally, an insulating glass layer 60*c* is 60 μm in thickness.

A sliding layer 60*d* is a layer that is six μm in length is provided on the surface of the substrate 60*a*, slides with an inner peripheral surface of the fixing sleeve 41, and includes a component is an imide-based resin material, such as polyimide (PI) or polyamideimide (PAI). The sliding layer 60*d* has a function in that it is excellent in a heat-resistant property, a lubricating property, and an anti-wearing property, and imparts a smooth sliding property with the inner peripheral surface of the fixing sleeve 41.

Heater Holder

As shown in FIG. 2, a heater holder 61, as a back-up member, is formed in a semicircular trough shape in cross section by a heat-resistant resin material, such as a liquid polymer resin material having a high heat-resistant property, as a member for holding (supporting) the heater 60. Further, the fixing sleeve 41 is externally fitted loosely around an outer peripheral surface of the heater holder 61.

Pressing Stay

As shown in FIG. 2, a pressing stay 62, as a skeleton member, is formed in a downward (reversed) U-shape in cross section by a rigid material, such as metal. This pressing stay 62 is provided inside the fixing sleeve 41 on a surface of the heater holder 61 that is opposite to the pressing roller 42. The pressing stay 62 is pressed toward the pressing roller 42 via the heater holder 61, the heater 60, and the fixing sleeve 41 by flanges 63 and pressing springs 64 shown in parts (a) and (b) of FIG. 4.

Air Blowing Means (Air Blowing Cooling Means)

As shown in FIG. 2 and parts (a) and (b) of FIG. 4, an air blowing cooling device 70U, as an air blowing means (capable of cooling longitudinal end portions of the fixing member by air blowing) for performing air blowing cooling, includes a cooling fan 71. The air blowing cooling device 70U further includes an air blowing duct (air blowing path) 72 for guiding air generated by the fan 71, and an air blowing port (opening) 73 provided as a part of the air blowing duct 72 in advance at a portion opposing the end portion region of the fixing sleeve 41 with respect to the longitudinal direction.

Further, the air blowing cooling device 70U includes a shutter 74, as a shielding portion capable of shielding at least one longitudinal region of the air blowing port 73, and having an opening width (air blowing region width) suitable for a width of the recording material P to be passed through the fixing device 40, and includes a shutter driving device (opening width adjusting means) 75 (FIG. 5) as a driving portion for driving the shutter 74.

In this embodiment, the air blowing cooling means is constituted by the cooling fan 71, the air blowing duct 72, and the air blowing port 73. Further, a control means (controller) for controlling the air blowing cooling means is constituted by the shutter 74 and the shutter driving device 75.

In the case of the center-basis feeding, the fans 71, the air blowing ducts 72, the air blowing ports 73, and the shutters 74 are disposed symmetrically with respect to a center position of longitudinal left and right portions (sides).

As the fan 71, a centrifugal fan, such as a sirocco fan, can be used. That is, the fan 71 cools a part of the recording material P with respect to the longitudinal direction perpendicular to the recording material feeding direction. The fan 71 is rotationally driven by a motor (not shown), and an air flow rate is determined by the number of rotations and a rotation time thereof, and by a shutter opening width. The left and right shutters 74 are supported slidably (movably) in a left-right direction along a plate surface of a supporting plate 76 (FIG. 4), which is provided with the air blowing ports 73, and which extends in the left-right direction.

The left and right shutters 74 are supported slidably in the left-right direction, along the plate surface of the supporting plate 76 extending in the left-right direction, so as to shield all or a portion of regions of the air blowing ports 73, with respect to the longitudinal direction, as predetermined openings. These left and right shutters 74 are connected with each other by rack teeth 77 and a pinion gear 78, and the pinion gear 78 is driven by being rotated normally or reversely by a motor (pulse motor) M2, shown in FIG. 5.

As a result, the left and right shutters 74 are opened or closed relative to the associated air blowing ports 73 in association with each other with a bilateral symmetrical relationship. The shutter driving device 75, as a driving portion for driving the shutters 74, is constituted by the supporting plate 76, the rack teeth 77, the pinion gear 78, and the motor M2.

The left and right air blowing ports 73 are provided in positions closer to the longitudinal center than the non-sheet-passing portions b, which are generated when the minimum width recording material is passed through the fixing device 40, to longitudinal ends of the maximum sheet-passing width W1. The left and right shutters 74 are disposed so as to close (shield) the air blowing ports 73 from a longitudinal center position side of the supporting plate 76 toward outsides (end portion sides) by a predetermined amount (all or a portion of the air blowing ports 73).

As regards positional information of the shutter 74 with respect to the longitudinal direction, a home position of the shutter 74 is detected in a manner such that a flag 80 (part (a) of FIG. 4), provided at a predetermined position of the shutter 74, is detected by a sensor 81 provided on the supporting plate 76. Further, the home position is determined at a shutter position in which the air blowing port 73 is fully closed, so that an opening amount X is detected from a rotation amount of the motor M2.

Image Size Detection

Referring to FIG. 1, a print job including a sheet (paper) size, an image, and the like, is sent from an unshown external host device, such as a computer or an image reader, to a controller portion 200. In the controller portion (acquiring portion) 200, image processing, including image development, color-separation, and the like, is carried out, and, at that time, an image size (particularly an image size with respect to the widthwise direction of the recording material P and an image size with respect to the recording material feeding direction) is detected (acquired).

Then, the controller portion 200 sends the sheet size in the print job and the image size of the recording material P to the controller 100.

The controller (control circuit portion) 100 causes the image forming apparatus to perform the image forming operation on the basis of inputted image information from the controller portion 200, so that a full-color image is formed on the recording material P. The controller 100 controls the air blowing cooling means on the basis of the image size sent from the controller portion 200, as described later.

As the image size, a size of a print region obtained by removing (subtracting) margins (for example, left margin (5 mm) and right margin (5 mm), i.e., (10 mm in total) from a sheet size (recording material size) set by an application software in an external host device is used. Alternatively, a maximum region in which image data, obtained from data subjected to image development by the controller portion 200 actually exists, is used.

Control of Air Blowing Cooling Means in Operation in Universal Mode

The maximum sheet-passing size in this embodiment is an A3R size (width: 297 mm×length: 420 mm). Accordingly, in a case in which the operation in the universal mode is selected, even when the size of the actually passed recording material P is less than the maximum sheet-passing size, as regards the feeding (conveyance) of the recording material P in the image forming apparatus, the recording material is fed as an A3R-size recording material, which is a maximum sheet-passing-size recording material. In this embodiment, however, as described below, in the longitudinal end portion regions of the fixing member, air blowing cooling is performed on the basis of the image size data sent from the controller portion 200 and, therefore, a non-sheet-passing portion temperature rise is suppressed.

That is, as shown in FIG. 9, on the basis of a main scan direction size (widthwise size) of the image size, a widthwise size (recording material size) of the passed recording material P is estimated, and then an open/close amount opening amount of the shutter 74 is controlled.

Here, a relationship between a shutter opening amount and the non-sheet-passing portion temperature rise in a conventional example and this embodiment (First Embodiment) is shown in Table 1. In Table 1, a case in which, as the recording material P, a maximum-size sheet (A3R size, width: 297 mm×length: 420 mm), a minimum-size sheet (A4R size, width: 210 mm×length: 297 mm), and a small-size sheet (B4R size: width: 257 mm×length: 364 mm), as an example, are passed through the fixing device, will be cited as an example.

TABLE 1

| Sheet | Actual | Image | Conventional Example | | First Embodiment | |
|---|---|---|---|---|---|---|
| Size | Size | Size | X*1 | TR*2 | X*1 | TR*2 |
| US*3 | A3R | 287 mm | 0 mm | NOT*4 | 0 mm | NOT*4 |
| US*3 | B4R | 247 mm | 0 mm | 200° C. | 20 mm | 180° C. |
| US*3 | A4R | 200 mm | 0 mm | 210° C. | 43 mm | 180° C. |

*1"X" is the opening width of the shutter 74.
*2"TR" is an approximate temperature at which the non-sheet-passing portion temperature rise occurred.
*3"US" is the universal size.
*4"NOT" represents that the non-sheet-passing portion temperature rise was not particularly observed.

Here, as regards the non-sheet-passing portion temperature rise in the fixing sleeve 41, in a case in which the recording materials P are continuously passed through the fixing device 40, a case in which the actual sheet-passing size is the A3R size is shown in FIG. 6, a case in which the actual sheet-passing size is the A4R is shown in FIG. 7, and a case in which the actual sheet-passing size is the B4R is shown in FIG. 8. Further, in each of FIGS. 6, 7, and 8, the conventional example is shown by a solid line and this embodiment (First Embodiment) is shown by a dotted line.

As regards FIG. 6, in the case of the A3R size, the controller portion 200 sends, to the controller 100, an image size width data set at 287 mm (i.e., 297 mm−10 mm), with left and right margins each of 5 mm. In the conventional example in FIG. 6, control is carried out, and, therefore, the opening amount X of the shutter 74 is 0 mm.

On the other hand, in this embodiment in FIG. 6, in the controller 100, the width of the passed recording material P is regarded as 297 mm (i.e., 287 mm+10 mm) from the image size width, and control is carried out so that the opening amount X is 0 mm. A surface temperature of the fixing sleeve 41 is controlled at about 170° C. (temperature control) in the sheet-passing portion from the viewpoint of the fixing property. On the other hand, the surface temperature of the fixing sleeve 41 in the non-sheet-passing portion is, as shown in FIG. 6, not greater than the surface temperature of the fixing sleeve in the sheet-passing portion in both of the conventional example (solid line) and this embodiment (dotted line), so that the non-sheet-passing portion temperature rise does not substantially occur.

Next, referring to FIG. 7, the surface temperature of the fixing sleeve 41 in the case in which the A4R size sheet is actually passed through the fixing device 40 will be described. In the conventional example, control is carried out on the assumption that the maximum-size sheet (maximum-width sheet) is passed through the fixing device 40, so that the opening amount X of the shutter 74 is 0 mm. For this reason, when the A4R-size sheet narrower in size in (width) than the maximum-size sheet is passed through the fixing device 40, as shown by the solid line of FIG. 7, the non-sheet-passing portion temperature rise occurred, so that the temperature at which the non-sheet-passing portion temperature rise occurred was about 210° C. to the maximum.

On the other hand, in this embodiment, in a case in which the image size width is 200 mm, in the controller 100, the actually passed recording material width is regarded as the A4R size width (210 mm (i.e., 200 mm+10 mm)) and the opening amount X of the shutter 74 is controlled to 43 mm. For this reason, the temperature at which the non-sheet-passing portion temperature rise occurred was capable of being reduced to about 180° C. to the extent that there is no problem in practical use.

Thus, in this embodiment, in a case in which the operation in the universal mode is selected, the controller 100 regards, as the recording material size with respect to the widthwise direction, a size obtained by adding a predetermined amount (value of the left and right margins) to the image size with respect to the widthwise direction, and then causes the shutter 74, as the shielding portion, to displace.

Next, referring to FIG. 8, the surface temperature of the fixing sleeve 41 in the case in which the B4R size sheet is actually passed through the fixing device 40 will be described. In the conventional example, control is carried out on the assumption that the maximum-size sheet (maximum-width sheet) is passed through the fixing device 40, so that the opening amount X of the shutter 74 is 0 mm. For this reason, when the B4R-size sheet narrower in size in (width) than the maximum-size sheet is passed through the fixing device, as shown by the solid line of FIG. 8, the non-sheet-passing portion temperature rise occurred, so that the temperature at which the non-sheet-passing portion temperature rise occurred was about 210° C. to the maximum.

On the other hand, in this embodiment, in a case in which the image size width is 247 mm, in the controller 100, the actually passed recording material width is regarded as the B4R size width (257 mm (i.e., 247 mm+10 mm)) and the opening amount X of the shutter 74 is controlled to 20 mm. For this reason, the temperature at which the non-sheet-passing portion temperature rise occurred was capable of being reduced to about 180° C. to the extent that there is no problem in practical use.

Thus, according to this embodiment, in a case in which the operation in the universal mode (second mode) is selected, the controller 100 regards, as the recording material size with respect to the widthwise direction, a size obtained by adding the predetermined amount to the image size with respect to the widthwise direction, and then causes the shutter 74, as the shielding portion for closing the opening, to displace. For this reason, even when the size of the recording material actually passed in the image forming apparatus is unclear (i.e., there is a possibility that the actually passed recording material is the small-size sheet narrower in width than the maximum-size sheet width), the non-sheet-passing portion temperature rise can be suppressed (reduced in degree) with a simple method.

Incidentally, in a case in which the regular size is designated (selected), in the above-described control, as the operation in the first mode, the shutter 74 as the shielding portion is displaced on the basis of the sheet size.

Second Embodiment

In First Embodiment, in the operation in the universal mode (second mode), the opening amount of the shutter 74 was controlled using the image size of the recording material with respect to the widthwise direction. In this embodiment, further using the image size of the recording material with respect to the recording material feeding direction, the opening amount of the shutter 74 is switched between a period in which the image region passes through the fixing device (within the image size region with respect to the recording material feeding direction) and a period in which a region other than the image region passes through the fixing device (out of the image size region with respect to the recording material feeding direction).

Also in this embodiment, in a case in which the universal mode (second mode) is designated (selected), control for feeding the recording material P as the maximum sheet-passing-size sheet (A3R feeding) is carried out. Incidentally, in this embodiment, a constitution similar to the constitution of the image forming apparatus in the First Embodiment will be omitted from description unless otherwise specified.

As the operation in this embodiment, an operation in a case in which the image size is 247 mm in width by 354 mm in length will be described. The image size in this embodiment is not, however, limited to this image size.

FIG. 9 is a schematic view for illustrating the universal size, the image size, and the like. The image size with respect to the recording material feeding direction is Y1, and a size, in the universal size, extending from a terminal end (lower end in FIG. 9) of the image size to a terminal end (lower end in FIG. 9) of the universal size is Y2. A result of opening amount control of the shutter 74 in the conventional example, the First Embodiment, and this embodiment (Second Embodiment) is shown in Table 2.

TABLE 2

| Sheet Size | Actual Size | Image Size | Region etc. | Opening amount CE*1 | E1*2 | E2*3 |
|---|---|---|---|---|---|---|
| US*4 | B4R | | Y1 | 0 mm | 20 mm | 20 mm |
| W:297 (mm) | W:257 (mm) | W:247 (mm) | Y2 | 0 mm | 20 mm | 43 mm |
| L:420 (mm) | L:364 (mm) | L:354 (mm) | TR*5 | 200° C. | 180° C. | 175° C. |
| | | | PRT*6 | 60 sec | 30 sec | 10 sec |

*1"CE" is the conventional example.
*2"E1" is First Embodiment.
*3"E2" is Second Embodiment.
*4"US" is the universal size.
*5"TR" is an appropriate temperature at which the non-sheet-passing portion temperature rise occurred.
*6"PRT" is a post-rotation time for extended cooling.

In the conventional example, control is carried out on the assumption that the maximum-size sheet is passed through the fixing device, and, therefore, the opening amount of the shutter 74 is controlled at 0 mm. For this reason, in a case in which the size of the actually passed sheet was the size of the small-size sheet narrower in width than the actually passed sheet, the non-sheet-passing portion temperature rise occurred. The non-sheet-passing portion temperature rise in a case in which the B4R-size sheet was passed through the fixing device occurred at about 200° C. In this case, in post-rotation, when a post-rotation extension cooling was performed for lowering the occurrence temperature of the non-sheet-passing portion temperature rise, it took about 60 seconds to reduce a degree of the non-sheet-passing portion temperature rise to a level such that there is no practical problem, such as paper (sheet) creases, or the like.

On the other hand, in First Embodiment, although the opening amount of the shutter 74 is controlled on the basis of the width of the image size, the opening amount of the shutter 74 is controlled at the same value between Y1 (within the image size) and Y2 (out of the image size), which are image sizes. For this reason, the occurrence temperature of the non-sheet-passing portion temperature rise was about 180° C. which was somewhat high, and the post-rotation cooling time was less than that in the conventional example, but was about 30 seconds.

On the other hand, in this embodiment (Second Embodiment), the opening amount of the shutter 74 is switched depending on the image size with respect to the recording material feeding direction. In the region of Y1 (within the image size with respect to the recording material feeding direction), the opening amount of the shutter 74 is controlled similarly as in the First Embodiment. In the region of Y2 (out of the image size with respect to the recording material feeding direction), however, the opening amount of the shutter 74 is increased (i.e., the opening is increased in exposed region). For this reason, in the region of Y2, an air blowing rate was increased and thus, the fixing device 40 was cooled (i.e., the degree of the non-sheet-passing portion temperature rise was reduced and the longitudinal temperature was uniformized) more than the fixing device of the First Embodiment, and, therefore, the temperature of the non-sheet-passing portion temperature was about 175° C. and thus, the temperature was further decreased compared with the First Embodiment. For this reason, the post-rotation extension cooling time was about 10 seconds, which was further decreased compared with the First Embodiment.

In the region of Y2, there is no image, and, therefore, even when the opening amount of the shutter 74 is increased, a problem, such as improper fixing, does not arise. In this embodiment, different from First Embodiment, by using the image size with respect to the recording material feeding direction, the opening amount of the shutter 74 is switched between the region within the image size with respect to the recording material feeding direction and the region out of the image size with respect to the recording material feeding direction. As a result, with a simple method, the degree of the non-sheet-passing portion temperature rise can be further suppressed (reduced), so that the extension time of the post-rotation can be suppressed (reduced).

Third Embodiment

This embodiment is different from the First and Second Embodiments in that, on the basis of the image size with respect to the recording material feeding direction, an air blowing rate of the cooling fan 71 is changed between the region within the image size with respect to the recording material feeding direction and the region out of the image size with respect to the recording material feeding direction. In this embodiment, members and portions that are the same as those of the image forming apparatuses of the First and Second Embodiments are represented by the same reference numerals or symbols, and will be omitted from redundant description. A result of comparison among this embodiment (Third Embodiment), and the conventional example, the First Embodiment, and the Second Embodiment is shown in Table 3. In Table 3, a case in which the image size is 247 mm in width and 354 mm in length is shown, but this embodiment is not limited thereto.

TABLE 3

| | | | | Conventional Example | | First Embodiment | | Embodiment 2 | | Embodiment 3 | |
|---|---|---|---|---|---|---|---|---|---|---|---|
| Sheet Size Designation | Actual Sheet Passing Size | Image Size | | Opening Amount of 74 | Air Blowing Rate of 71 | Opening Amount of 74 | Air Blowing Rate of 71 | Opening Amount of 74 | Air Blowing Rate of 71 | Opening Amount of 74 | Air Blowing Rate of 71 |
| Universal Size (width: 297 mm, length: 420 mm) | B4R size (width: 257 mm, length: 364 mm) | width: 247 mm, length: 354 mm | Passing Region Y1 | 0 mm | 0 m/s | 20 mm | 8 m/s | 20 mm | 8 m/s | 20 mm | 8 m/s |
| | | | Passing Region Y2 | 0 mm | 0 m/s | 20 mm | 8 m/s | 43 mm | 8 m/s | 20 mm | 12 m/s |
| | | | Temperature Rise | about 200° C. | | about 180° C. | | about 175° C. | | about 175° C. | |
| | | | Post-rotation Time | about 60 seconds | | about 30 seconds | | about 10 seconds | | about 10 seconds | |

As shown in Table 3, in this embodiment, in the region within the image size with respect to the recording material feeding direction, i.e., during passing of the image (recording material) through the fixing device 40 (in the region of Y1 in FIG. 9), the air blowing rate is about 8 m/s, which is a normal air blowing rate and which is the same as the air blowing rate in the First Embodiment and the Second Embodiment. Different from the conventional example, however, in the First Embodiment and the Second Embodiment, in the region out of the image size with respect to the recording material feeding direction, i.e., in the region (Y2) extending from the terminal end of the image size to the terminal end of the universal size with respect to the recording material feeding direction, the air blowing rate of the cooling fan 71 is increased to about 12 m/s at which the control is carried out.

For this reason, different from the Second Embodiment, in which the opening amount of the shutter 74 is changed between the region (Y1) within the image size with respect to the recording material feeding direction and the region (Y2) out of the image size with respect to the recording material feeding direction, even when the opening amount of the shutter 74 is not changed, only by changing the air blowing rate of the cooling fan 71, the degree of the non-sheet-passing portion temperature rise is reduced, so that the post-rotation extension cooling time was capable of being shortened.

In this embodiment, compared with the Second Embodiment, the number of times of switching of the opening amount of the shutter 74 can be reduced, so that a lifetime of the shutter driving device (driving portion) 75 for driving the shutter 74 can be extended.

Modified Embodiment

In the above description, preferred embodiments of the present invention were described. The present invention is not limited, however, to these embodiments, but can be variously modified and changed within the scope of the present invention.

Modified Embodiment 1

The Second Embodiment and the Third Embodiment were described on the premise that these embodiments are independently employed, but a constitution using these embodiments in combination can also be employed. That is, on the basis of the image size with respect to the recording material feeding direction, in the region extending from the terminal end of the image size (image) with respect to the recording material feeding direction, air blowing cooling may also be performed so that the air blowing rate is increased in a region broader than the longitudinal end portion regions.

Modified Embodiment 2

In the above-described embodiments, the air blowing cooling device 70U suppressed the non-sheet-passing portion temperature rise of the fixing sleeve 41, but may also only be required to be constituted so as to suppress the non-sheet-passing portion temperature rise of at least one of the fixing sleeve 41 and the pressing roller 42, which are the fixing members.

Modified Embodiment 3

In the above-described embodiments, the fixing sleeve and the pressing roller were used as the first fixing member and the second fixing member, respectively, but the present invention is not limited thereto. For example, an endless belt may also be used as at least one of the first and second fixing members.

Further, as the heat generating member for heating the nip, the heater sliding with the inner surface of the endless belt as described above can be used. Further, it is also possible to use a rotatable endless belt including a heat generating layer, and, in this case, the endless belt also serves as the heat generating member for heating the nip. Further, in this case, the heat generating layer can have a constitution in which the heat generating layer generates heat through an exciting coil or energization.

Modified Embodiment 4

In the above-described embodiments, as the recording material P, the recording paper was described, but the recording material P in the present invention is not limited to the paper. In general, the recording material P is a sheet-like member on which the toner image is formed by the image forming apparatus and includes, for example, regular or irregular materials, such as plain paper, thick paper, thin paper, an envelope, a postcard, a seal, a resin sheet, an overhead projector (OHP) sheet, and glossy paper. In the above-described embodiments, for convenience, handling of the recording material (sheet) P was described using terms such as the sheet passing, the sheet feeding, the sheet discharge, and the non-sheet-passing portion, but by these terms, the recording material P in the present invention is not limited to the paper.

Modified Embodiment 5

In the above-described embodiments, the fixing device for fixing the unfixed toner image on the sheet was described as an example, but the present invention is not limited thereto. The present invention is also similarly applicable to a device for heating and pressing a toner image temporarily fixed on the sheet in order to improve a gloss (glossiness) of an image (also in this case, the device is referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

(A) an image forming portion configured to form an image on a recording material;

(B) a first fixing member;

(C) a second fixing member configured to form a nip with said first fixing member, in which the recording material, carrying the image thereon, is nipped and fed;

(D) an air blowing cooling device configured to blow air for cooling an end portion region of at least one of said first fixing member and said second fixing member with respect to a longitudinal direction, perpendicular to a recording material feeding direction, in the nip, said air blowing cooling device including:

(a) a cooling fan; and (b) an air blowing duct; and (E) a controller capable of selecting one of (i) an operation in a first mode, in which cooling of the end portion region by said air blowing cooling device is carried out depending on a recording material size, with respect to a widthwise direction of the recording material, and (ii) an operation in a second mode, in which the cooling is carried out depending on a size of a print region of the image, with respect to a direction perpendicular to the recording material feeding direction.

2. The image forming apparatus according to claim 1, wherein, when the operation in the second mode is selected, said controller regards, as the recording material size, a size obtained by adding a predetermined amount to the size of the print region of the image, with respect to the widthwise direction, and causes said air blowing cooling device to carry out the cooling of the end portion region.

3. The image forming apparatus according to claim 1, wherein, on the basis of the size of the print region of the image, with respect to the recording material feeding direction, said controller causes said air blowing cooling device to blow air so as to cool a region that extends from an end edge of the image, with respect to the recording material feeding direction, and that is broader than the end portion region with respect to the longitudinal direction.

4. The image forming apparatus according to claim 1, wherein, on the basis of the size of the print region of the image, with respect to the recording material feeding direction, said controller increases an air speed of said air blowing cooling device, so that the air speed in a region extending from an end edge of the image, with respect to the recording material feeding direction, is greater than the air speed in a region in which the image exists on the recording material, with respect to the recording material feeding direction.

5. The image forming apparatus according to claim 1, wherein the end portion region cooled by said air blowing cooling device is provided on each of two ends, with respect to the longitudinal direction.

6. The image forming apparatus according to claim 1, wherein said first fixing member is a rotatable endless belt and includes, as a heat generating member, a heater that is slidable with an inner surface of said endless belt.

7. The image forming apparatus according to claim 1, wherein said first fixing member is a rotatable endless belt including a heat generating layer that functions as a heat generating member.

8. The image forming apparatus according to claim 7, wherein said heat generating layer generates heat by an exciting coil or by energization.

9. The image forming apparatus according to claim 1, wherein said second fixing member is a pressing roller.

10. A fixing device comprising:

(A) a first fixing member;

(B) a second fixing member configured to form a nip, with said first fixing member, in which a recording material carrying an image thereon is nipped and fed;

(C) an air blowing cooling device configured to blow air for cooling an end portion region of at least one of said first fixing member and said second fixing member with respect to a longitudinal direction, perpendicular to a recording material feeding direction, in the nip, said air blowing cooling device including:

(a) a cooling fan; and (b) an air blowing duct; and (D) a controller capable of selecting one of (i) an operation in a first mode, in which cooling of the end portion region by said air blowing cooling device is carried out depending on a recording material size, with respect to a widthwise direction of the recording material, and (ii) an operation in a second mode, in which the cooling is carried out depending on a size of a print region of the image, with respect to a direction perpendicular to the recording material feeding direction.

11. The fixing device according to claim 10, wherein, when the operation in the second mode is selected, said controller regards, as the recording material size, a size obtained by adding a predetermined amount to the size of the print region of the image, with respect to the widthwise direction, and causes said air blowing cooling device to carry out the cooling of the end portion region.

12. The fixing device according to claim 10, wherein, on the basis of the size of the print region of the image, with respect to the recording material feeding direction, said controller causes said air blowing cooling device to blow air so as to cool a region that extends from an end edge of the image, with respect to the recording material feeding direction, and that is broader than the end portion region with respect to the longitudinal direction.

13. The fixing device according to claim 10, wherein, on the basis of the size of the print region of the image, with respect to the recording material feeding direction, said controller increases an air speed of said air blowing cooling device, so that the air speed in a region extending from an end edge of the image, with respect to the recording material feeding direction, is greater than the air speed in a region in which the image exists on the recording material, with respect to the recording material feeding direction.

14. The fixing device according to claim 10, wherein the end portion region cooled by said air blowing cooling device is provided on each of two ends, with respect to the longitudinal direction.

15. The fixing device according to claim 10, wherein said first fixing member is a rotatable endless belt and includes, as a heat generating member, a heater that is slidable with an inner surface of said endless belt.

16. The fixing device according to claim 10, wherein said first fixing member is a rotatable endless belt including a heat generating layer that functions as a heat generating member.

17. The fixing device according to claim 16, wherein said heat generating layer generates heat by an exciting coil or by energization.

18. The fixing device according to claim 10, wherein said second fixing member is a pressing roller.

* * * * *